United States Patent [19]

Bai

[11] Patent Number: 4,986,334

[45] Date of Patent: Jan. 22, 1991

[54] BOTTOM VERTICAL SLIDE ON A HORIZONTAL MOVABLE DIE OF A VERTICAL INJECTOR DIE CASTING MACHINE

[75] Inventor: Shen H. Bai, Toledo, Ohio

[73] Assignee: Farley, Inc., Chicago, Ill.

[21] Appl. No.: 535,662

[22] Filed: Jun. 11, 1990

[51] Int. Cl.[5] ..... B22D 17/12; B22D 17/26; B22D 17/30

[52] U.S. Cl. ..... 164/312; 164/342; 164/343

[58] Field of Search ..... 164/312, 314, 341, 342, 164/343

[56] References Cited

U.S. PATENT DOCUMENTS

| | | | |
|---|---|---|---|
| 4,655,274 | 4/1987 | Dannoura | 164/342 X |
| 4,690,197 | 9/1987 | Dannoura | 164/312 |
| 4,741,379 | 5/1988 | Dannoura | 164/312 |
| 4,799,534 | 1/1989 | Ueno et al. | 164/312 X |
| 4,836,267 | 6/1989 | Ueno et al. | 164/312 X |

FOREIGN PATENT DOCUMENTS

| | | | |
|---|---|---|---|
| 63-256257 | 10/1988 | Japan | 164/312 |
| 63-273559 | 11/1988 | Japan | 164/312 |

*Primary Examiner*—Richard K. Seidel
*Assistant Examiner*—J. Reed Batten, Jr.
*Attorney, Agent, or Firm*—Hugh Adam Kirk

[57] ABSTRACT

A horizontally movable die has a bottom slide and co-operates with a stationary die in a die casting machine, which machine has a vertical injector for molten metal mounted underneath the dies and oscillatable to an acute angle to the vertical from under the dies for filling with molten metal. The outwardly movable shot sleeve of the injector seats in two semi-annular docking blocks, one mounted in the stationary die and the other mounted on an outward projection or extended portion of the slide on the movable die. Thus, when the dies are closed, the two semi-annular docking blocks for the shot sleeve form an aperture completely within the stationary die, which aperture communicates with an outwardly tapered trough duct that extends to the casting between the dies. This trough configuration forms a sprue in the stationary die that permits the separation of the movable die from the stationary die and then the retraction of the bottom slide without obstruction by any part of the sprue or the casting. This configuration also enables the vertical injector's shot sleeve to be injected between the stationary die and a bottom slide on the movable die. Additional slides may be employed on the movable die, and ejector pins are preferably provided in the movable die for ejecting the casting after the dies and slides have been retracted.

6 Claims, 6 Drawing Sheets

30
50
41
36
102
40
42
2B
2B
30
36
102
41
2A
2A
50
38
34
33
48
37
44
54
52
24
26
30
50
41
36
102

BOTTOM VERTICAL SLIDE ON A HORIZONTAL MOVABLE DIE OF A VERTICAL INJECTOR DIE CASTING MACHINE

BACKGROUND OF THE INVENTION

This invention is an improvement for U.S. Pat. No. 4,655,174 of Dannoura issued Apr. 7, 1987 and assigned to UBE Industries, Ltd. This patent discloses a horizontal movable die cooperating with a stationary die in a die casting machine, which machine has an oscillatable vertical injector under the dies. The injector cooperates with a split docking block shared between the parting surfaces of the stationary and movable dies.

SUMMARY OF THE INVENTION

Generally speaking, the dies of this invention, and particularly the bottom vertical slide on the movable die, are for a horizontal movable die casting machine having a vertical injector beneath the dies. This injector may oscillate, rock, or swing from a molten metal filling position at about a 15° acute angle with the vertical out from under the dies to a molten metal injecting position under the adjacent parting surfaces of the movable and stationary dies. The docking block for the shot sleeve from the injector comprises two semi-annular or semi-cylindrical parts, one in the stationary die and the other in the bottom slide of the movable die, so that they cooperate to form a diametrically split docking block or seat for the shot sleeve.

In order for a bottom slide on a horizontal movable die to be used with a die casting machine with a vertical injector, this slide is provided with an outwardly projecting portion for the half of the docking block on the movable die. This projection enables the sprue formed from the whole open end of the docking block to be completely formed in a tapered cavity and groove in the stationary die so that retraction of the movable die may take place and then retraction of its bottom slide without obstruction from any part of the sprue or casting. Correspondingly, the stationary die is undercut to provide for the particular projection on the slide, which undercut has the other half of the docking block or semi-annular bushing for seating the shot sleeve when the dies are closed.

If desired, the movable die may have a plurality of slides at various angles, including horizontal opposite slides and/or a top vertical slide. Also the movable die is preferably provided with ejector pins for removing the casting from the movable die after the casting has been formed and the dies have been parted or retracted.

OBJECTS AND ADVANTAGES

It is an object of this invention to provide a simple, efficient, effective and economic movable die with a bottom slide for a split annular docking block between the parting surfaces of the stationary and movable dies for a vertical injector of a die castiing machine.

Another object is to produce a pair of cooperating dies for such a die casting machine that forms a sprue that does not obstruct the retraction of any of the die parts, and particularly the vertical bottom slide on the movable die.

BRIEF DESCRIPTION OF THE DRAWINGS

The above mentioned and other features, objects and advantages, and a manner of attaining them are described more specifically below by reference to an embodiment of this invention shown in the accompanying drawings, wherein.

DETAILED DESCRIPTION OF PREFERRED EMBODIMENT

Figure 1:
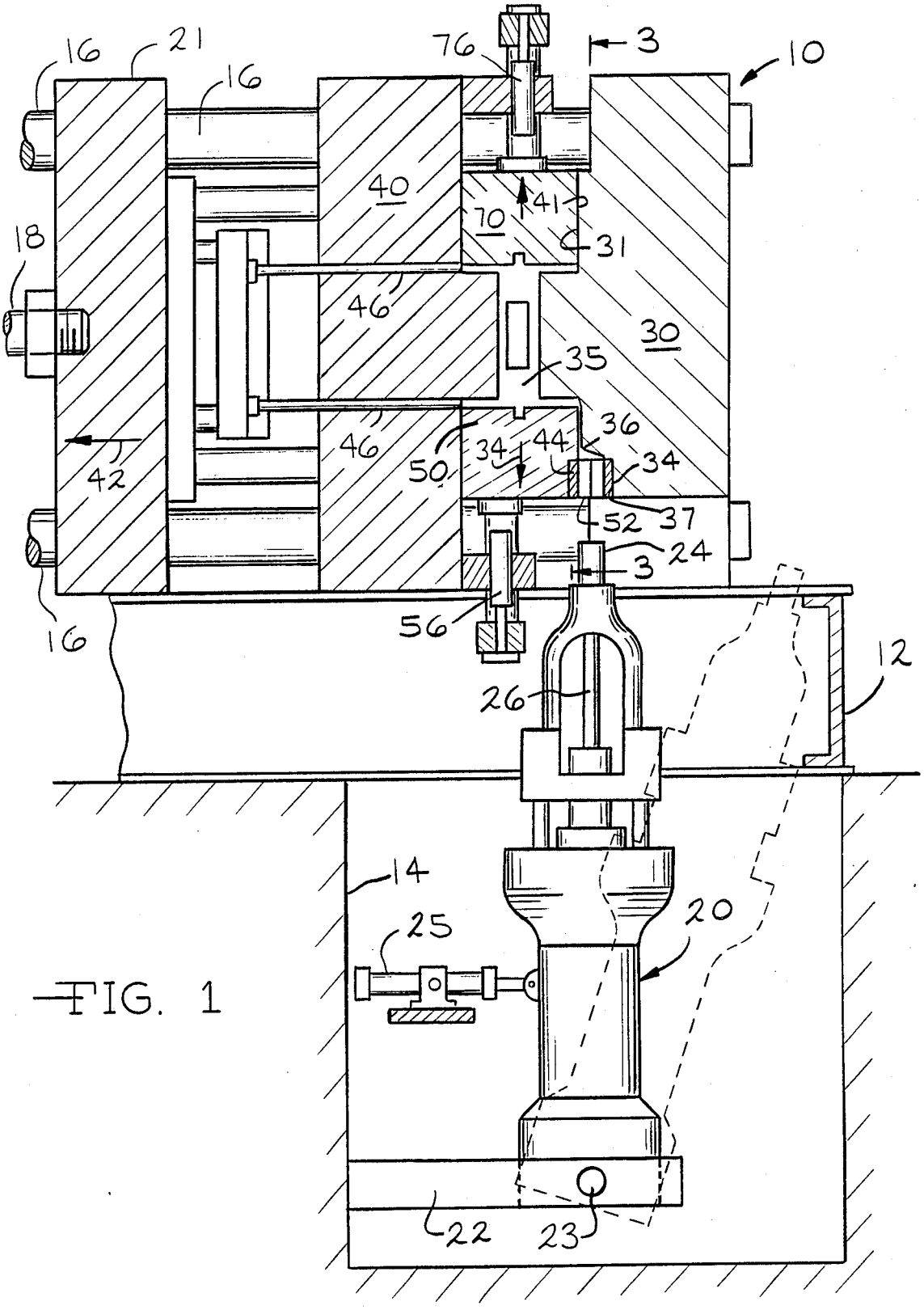
FIG. 1 is a side elevation of the die casting die part of a horizontal die casting machine having a vertical oscillatable molten metal injector mounted below the dies in the injecting position and in dotted lines in its filling position, said dies being shown in vertical section incorporating top and bottom vertical slides on the movable die, with the bottom slide provided with a projection for half of a docking block for the injector sleeve, the other half of which docking block is mounted in an undercut portion of the stationary die according to a preferred embodiment of this invention.
Figure 3:
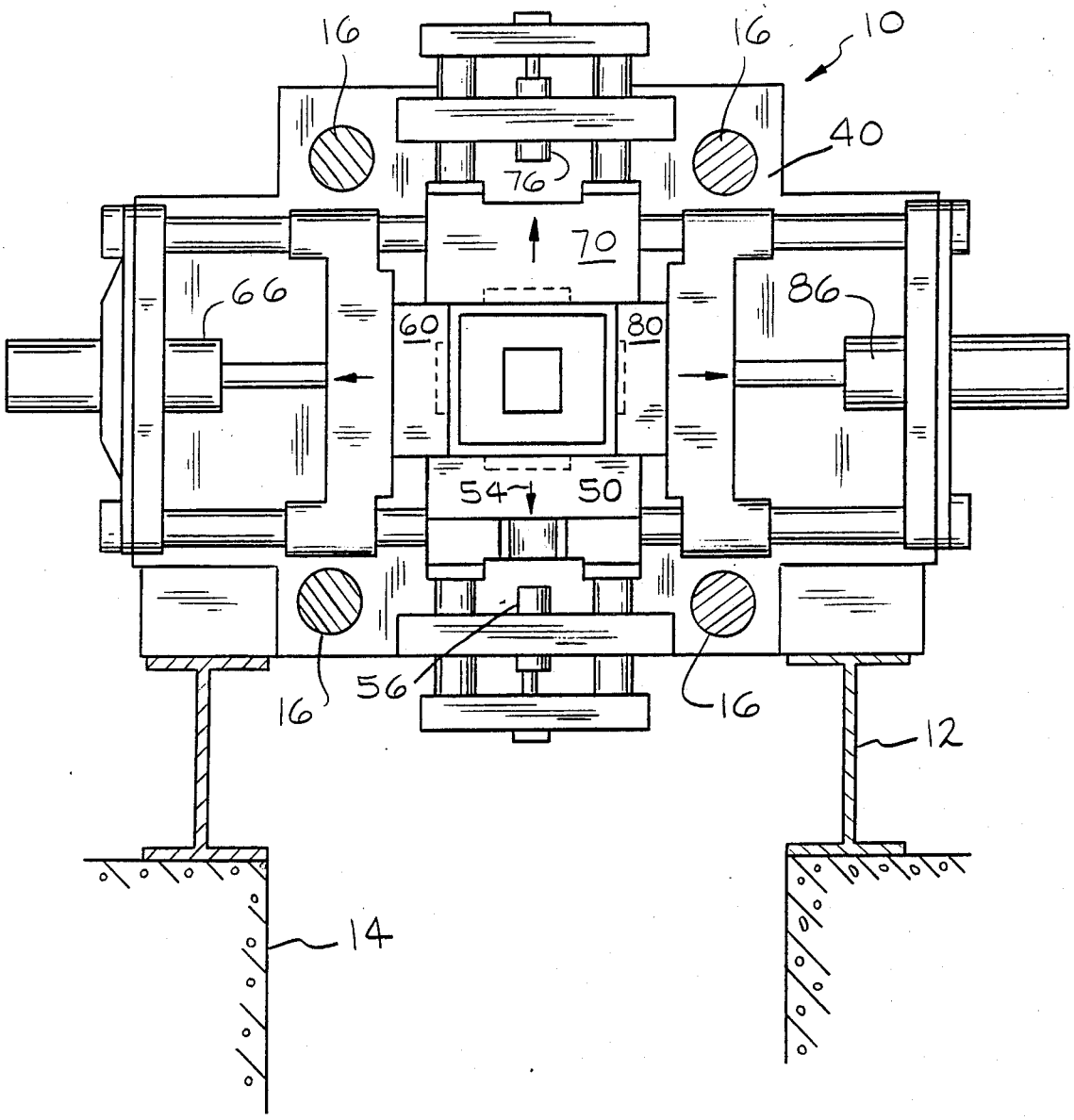
FIG. 3 is a vertical section taken along line 3—3 of FIG. 1 showing the movable die with four orthogonal slides.

Referring first to FIGS. 1 and 3, there is shown the die portion of a horizontal die casting machine 10 mounted on a base 12 over a pit 14. This die casting machine comprises a stationary die 30 and a movable die 40 with at least a bottom slide 50, and may contain three other slides 60, 70 and 80 (see FIGS. 3 and 8). In the pit 14 below the dies 30 and 40 is mounted a vertical oscillating molten metal injector device 20. The movable die 40 engages the stationary die 30 at their parting surfaces 41 and 31, respectively. The movable die 40 is slideable along the rail rods 16 by the action of the piston rod 18 threadedly anchored into the movable platen 21 for the movable die 40.

Figures 2, 2A, 2B:
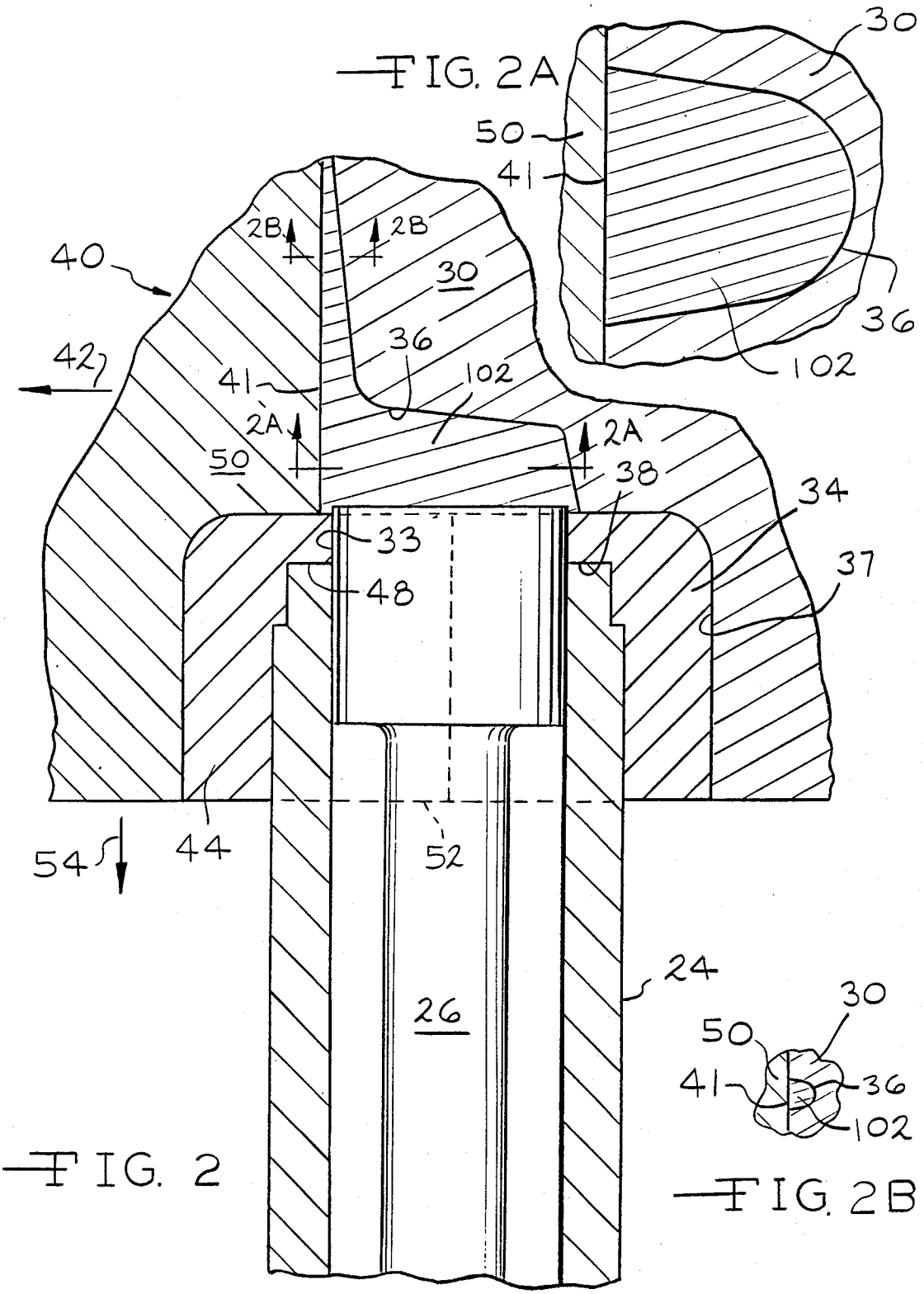
FIG. 2 is an enlarged vertical sectional view of the bottom vertical slide projection with its half of the docking block and the other half of the docking block in a stationary die, showing the sprue formed in the tapered cavity and duct therefrom in the stationary die; and the shot sleeve with its pistons being in their fully extended positions seated in the two halves of the docking block.
FIGS. 2A and 2B are sections along lines 2A—2A and 2B—2B of FIG. 2 showing the tapered sides of the duct that forms the sprue.
Figure 4:
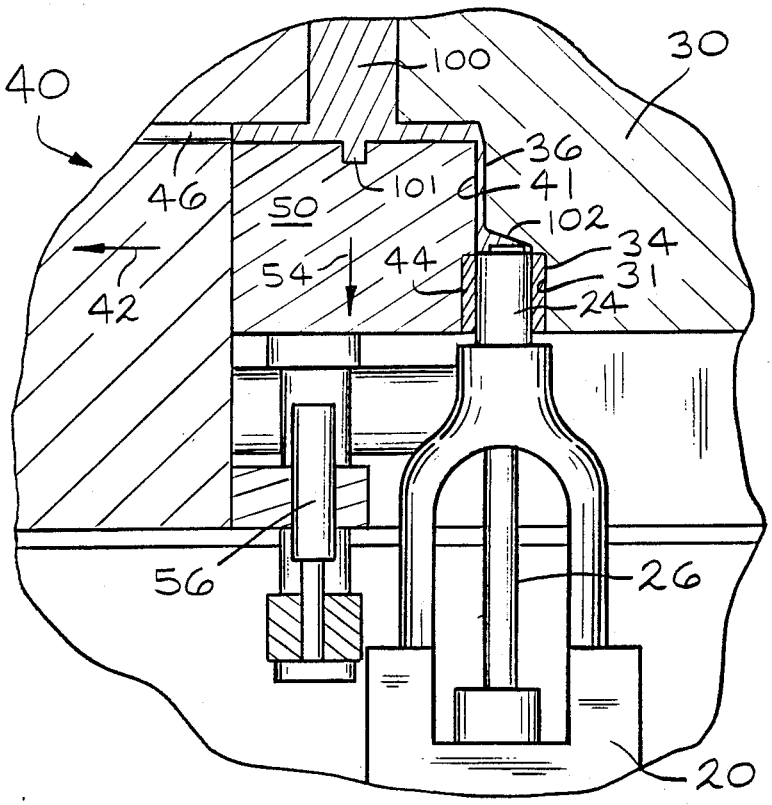
FIG. 4 is an enlarged sectional view of the split docking block between the stationary die and projection on the bottom movable slide of the movable die with the slide and dies closed, the shot sleeve of the injector extended, and the casting sprue and part of the casting filled with molten metal.
Figure 5:
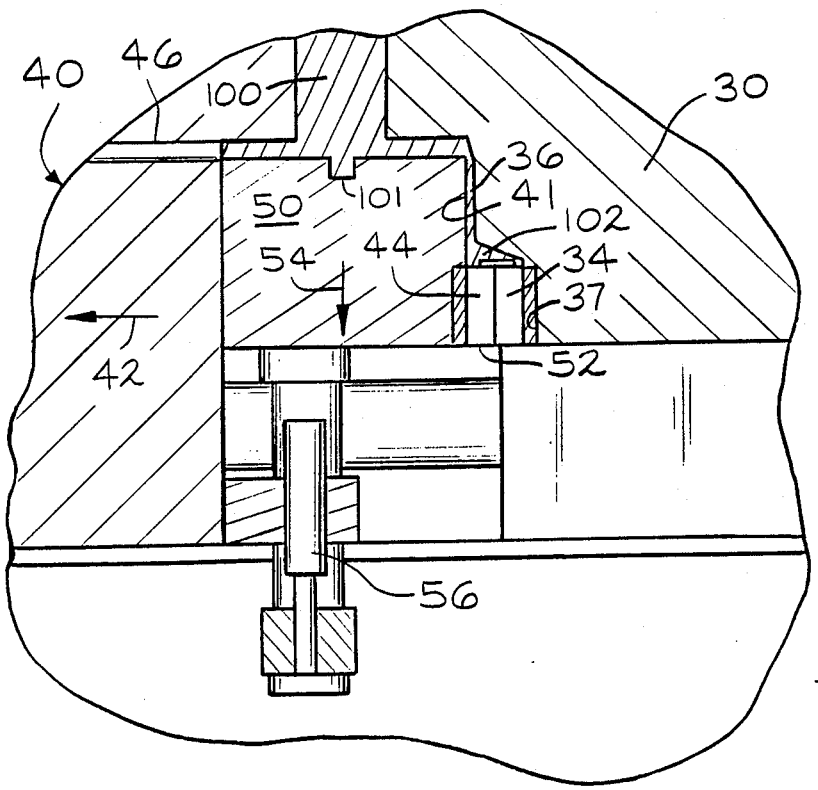
FIG. 5 is similar to FIG. 4 with the injector retracted and tilted out of view showing the split docking block between the stationary die and the bottom movable slide on the movable die.

The substantially vertical molten metal injector device or mechanism 20 is shown mounted on a bracket 22 in the pit 14 by means of a pivot 23. This injector 20 may be rocked or oscillated from its full-line molten metal injecting position into its dotted-line molten metal filling position (shown in FIG. 1) by means of a reciprocating motor 25, such as a hydraulic cylinder and piston, also mounted in the pit 14. At the upper end of the injector mechanism 20 there is shown in FIGS. 1, 2 and 4, a shot sleeve 24 inside of which is a piston 26 (see FIGS. 2 and 4) for injecting molten metal into the cavity 35 in the mold or dies 30 and 40 to form a casting 100 (see FIGS. 4 through 7 and 9).

Referring now to the stationary die 30, there is shown mounted in its lower portion, a notch or inset 37 in its parting surface 31 sufficient for the major portion of a docking block of which a half 34 is permanently mounted in said notch 37 of the stationary die. This semi-circular or semi-annular bushing 34 is shown better in FIGS. 2, 6 and 7, and is recessed sufficiently to completely contain at least the whole aperture 33 (see FIG. 2) at the inner end of the docking block halves 34 and 44. This aperture 33 joins the bevelled cavity and trough duct 36 (see also FIGS. 2A and 2B) which has divergent or outwardly tapered sides for easy separation of the movable die 40 in the direction of the arrow 42. Thus, as more clearly shown in FIGS. 2, 2A and 2B, all of the molten metal injected into the dies by the piston 26 is through the tapered cavity and duct 36 in the stationary or fixed die 30, which duct 36 completely covers the open end of the docking block halves 34 and 44, and thence by ducts and runners only in the stationary die parting surface 31 to the casting cavity 35. This duct 36 forms the sprue 102 on the casting 100. Also as shown in FIG. 2, the end of the piston 26 extends very slightly beyond the outer edge of the aperture 33 to insure that there will be no obstruction of the sprue being caught into the aperture 33 after the piston 26 has been withdrawn.

Referring now to the movable die 40 and its lower or bottom slide 50, this slide 50 is provided with an outward extended portion 52 into which the other half of the docking block 44 is embedded and attached. Thus, when the dies 30 and 40 and slide 50 are closed as shown in their full-line positions in FIGS. 1 through 5, the two complementary semi-annular bushing portions 34 and 44 of the docking block form a shouldered seat 38 and 48 for the shot sleeve 24 as shown in FIG. 2, so that the hot molten metal can be forced by the piston 26 directly into the trough duct 36 and thence into the cavity 35 of the mold for forming the casting 100 and its attached sprue 102. Thus, this extension 52 for half of the docking block 44 enables the movable die of a die casting machine of the type referred to above in Dannoura U.S. Pat. No. 4,655,274 to be employed with a bottom vertical slide on its movable die. If the sprue were partly embedded in the parting surface of the slide 50, the slide 50 could not be retracted.

Referring now to FIGS. 3 through 9, there are shown three other slides orthogonal to the slide 50 and to each other, namely slides 60, 70, 80. Each of the four slides 50, 60, 70 and 80 has its own reciprocating hydraulic motor 56, 66, 76 and 86, respectively. The purpose of such slides 50, 60, 70 and 80 is to enable additional configurations, projections and depressions, such as projections 101 formed on the casting 100 to be employed on a casting, enabling more complicated castings to be made. Although ejector pins 46 are shown in the movable die 40, other ejector pins also may be placed, if necessary, in the stationary die 30.

Figure 6:
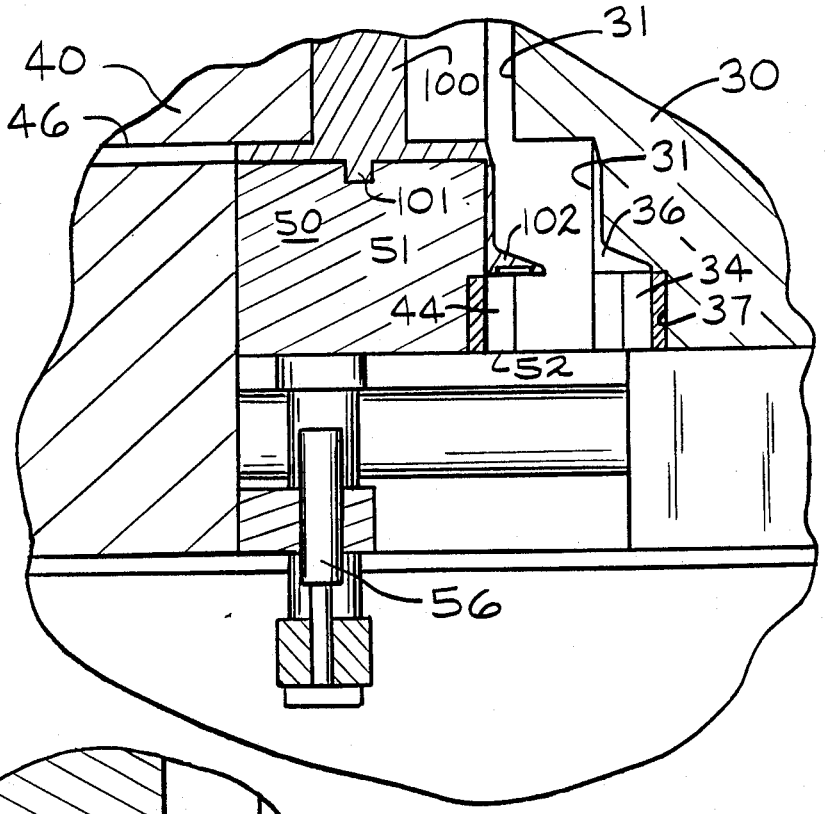
FIG. 6 is similar to FIG. 5 with the movable die and its bottom movable slide moved away or retracted from the stationary die separating the two halves of the split docking block and removing the sprue from the stationary die.
Figure 7:
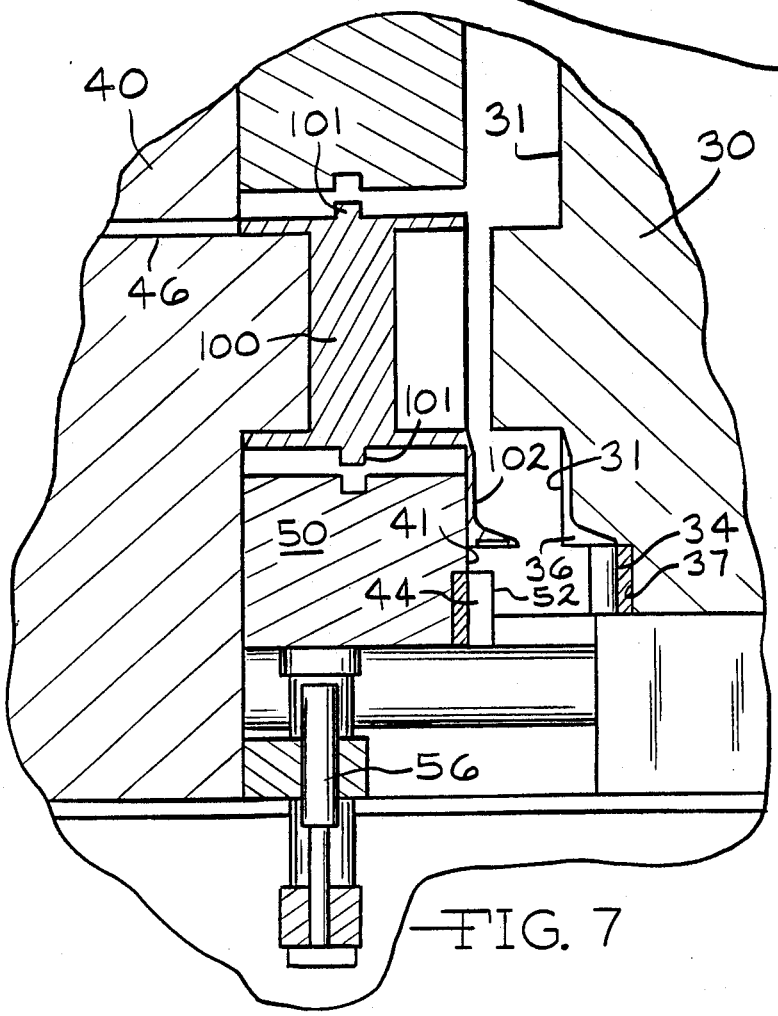
FIG. 7 is similar to FIG. 6 with the slide retracted, unobstructed by any portion of the sprue.
Figure 8:
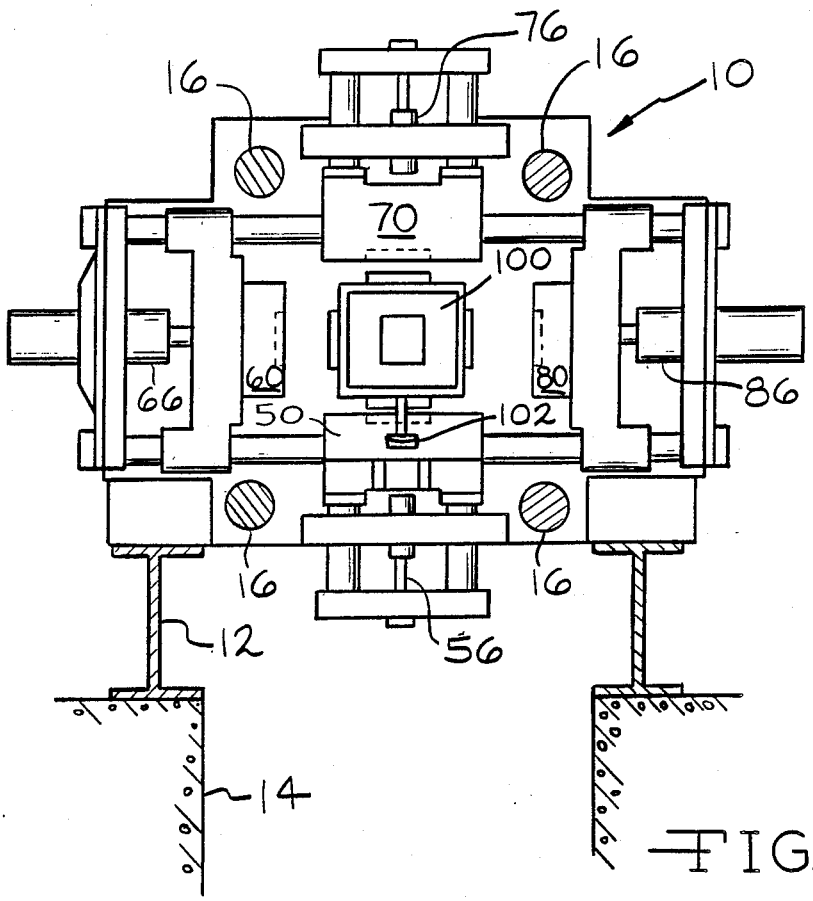
FIG. 8 is a view similar to FIG. 3, but reduced in size with all four of the slides being retracted.
Figure 9:
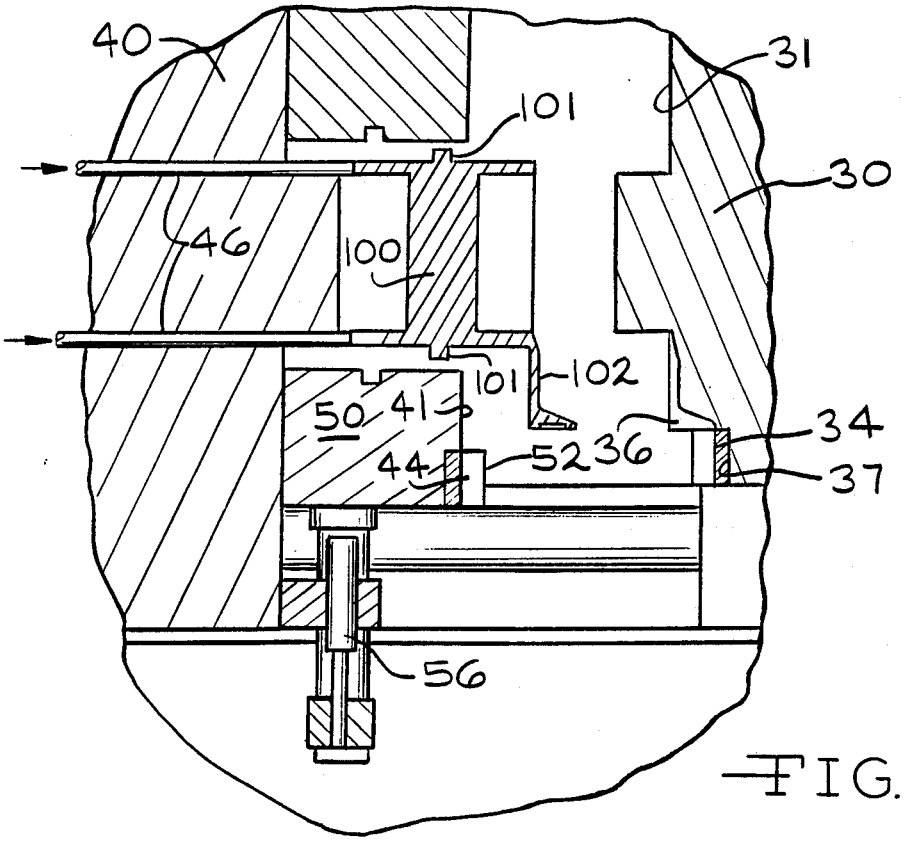
FIG. 9 is similar to FIG. 7 with the ejector pins extended and ejecting the casting and its sprue from the movable die.

Following through the operation of the dies 30 and 40 and slide 50 of this invention, while the dies and slides are all open as shown in FIG. 8, the ejector 20 is in its dotted line position shown in FIG. 1. First the movable die 40 and its slides 50, 60, 70 and 80 are closed so that its parting surface 41 is in contact with the parting surface 31 of the stationary, cover, or fixed die 30. In the meantime, the shot sleeve 24 of the injector mechanism 20 is filled with molten metal, in that its piston 26 has been completely retracted for this purpose. Then the injector mechanism 20 is tilted into its full-line vertical position shown in FIG. 1 and the shot sleeve 24 is extended as shown in FIGS. 2 and 3 to engage the docking blocks 34, 44. Once the shot sleeve 24 is seated in the two complementary docking block halves 34 and 44, the piston 26 ejects all the molten metal in the sleeve into the cavity 35 of the dies 30 and 40 via the tapered trough duct 36 to form the casting 100 and its sprue 102. When the molten metal has solidified in the die cavity, the piston 26 and shot sleeve 24 are retracted into the oscillatable injection mechanism 20 and it may be rocked away into the dotted-line position ready for filling for making the next die casting. Now the dies and casting are in position shown in FIG. 5 so that the movable die 40 with its extended slide 50 can be opened or moved away from the stationary die 30 as shown in FIG. 6. After this operation, the slides 50, 60, 70 and 80 may be retracted as shown in FIGS. 7, 8 and 9. Lastly, the ejector pins 46 are extended to remove the casting 100 and its sprue 102 from the die 40 as shown in FIG. 9.

Although the above operation was described as a series of steps, its description was only by way of example in that some of the steps may be performed in parallel or simultaneously or in another sequence without departing from the scope of this invention.

While there is described above the principles of this invention in connection with specific apparatus, it is to be clearly understood that this description is made only by way of example and not as a limitation to the scope of this invention.

I claim:

1. Dies for a horizontal die casting machine with a vertical injector, said dies comprising a stationary die with a parting surface and a horizontal movable die with a parting surface adjacent the said parting surface of said stationary die, said vertical injector movable beneath said dies for injecting molten metal into said dies when said dies are closed, said injector having an axially upwardly movable shot sleeve at its upper end, the improvement comprising:

(A) a vertically movable slide in the lower parting surface of said movable die, said slide having an outwardly projecting portion with a half annular docking block in the outer end of said portion, (B) a complementary half annular docking block in a recess in said parting surface of said stationary die for forming with said half docking block in said slide, a complete annular seat for said shot sleeve of said injector, and (C) an outwardly tapered trough duct in said parting surface of said stationary die surrounding the two halves of said docking block, said duct conducting molten metal from said shot sleeve into said dies.

2. Dies according to claim 1 wherein said half docking blocks are semi-annular bushings.

3. Dies according to claim 1 wherein said movable die includes a plurality of slides.

4. Dies according to claim 3 wherein said slides are opposing horizontal slides.

5. Dies according to claim 3 wherein said slides include a top vertical slide.

6. Dies for a horizontal die casting machine with a vertical injector, said dies comprising a stationary die with a parting surface, and a horizontal movable die with a parting surface adjacent the said parting surface of said stationary die, said vertical injector oscillatable beneath said dies for injecting molten metal into said dies when said dies are closed, said injector oscillatable between a vertical die injecting position and a molten metal filling position at an acute angle to the vertical away from said dies, said injector having an axially upwardly movable shot sleeve at its upper end, the improvement comprising:

(A) a vertically movable slide in the lower parting surface of said movable die, said slide having an outwardly projecting portion with a half annular docking block in the outer end of said portion, (B) a complementary half annular docking block in a recess in said parting surface of said stationary die for forming with said half docking block in said slide, a complete annular seat for said shot sleeve of said injector, and (C) an outwardly tapered trough duct in said parting surface of said stationary die surrounding the two halves of said docking block, said duct conducting molten metal from said shot sleeve into said dies.

* * * * *

UNITED STATES PATENT AND TRADEMARK OFFICE

CERTIFICATE OF CORRECTION

PATENT NO. : 4,986,334

DATED : January 22, 1991

INVENTOR(S) : Shen Hum BAI

It is certified that error appears in the above-identified patent and that said Letters Patent is hereby corrected as shown below:

Column 1, line 8, change "4,655,174" to - - 4,655,274 - - .

Signed and Sealed this

Twenty-eighth Day of July, 1992

*Attest:*

DOUGLAS B. COMER

*Attesting Officer*

*Acting Commissioner of Patents and Trademarks*